US008920205B2

(12) United States Patent
McCarthy

(10) Patent No.: US 8,920,205 B2
(45) Date of Patent: Dec. 30, 2014

(54) PERSONAL FLOATATION DEVICE

(71) Applicant: Daniel P. McCarthy, Long Valley, NJ (US)

(72) Inventor: Daniel P. McCarthy, Long Valley, NJ (US)

( * ) Notice: Subject to any disclaimer, the term of this patent is extended or adjusted under 35 U.S.C. 154(b) by 0 days.

(21) Appl. No.: 13/970,946

(22) Filed: Aug. 20, 2013

(65) Prior Publication Data

US 2014/0051309 A1 Feb. 20, 2014

Related U.S. Application Data

(60) Provisional application No. 61/691,095, filed on Aug. 20, 2012.

(51) Int. Cl.

| | |
|---|---|
| ***B63C 9/08*** | (2006.01) |
| ***B63C 9/19*** | (2006.01) |
| ***B63C 9/00*** | (2006.01) |
| *B63C 9/13* | (2006.01) |

(52) U.S. Cl.

CPC . *B63C 9/081* (2013.01); *B63C 9/19* (2013.01); *B63C 9/00* (2013.01); *B63C 2009/131* (2013.01)

USPC ..... 441/93; 441/92

(58) Field of Classification Search

USPC ..... 441/92–94, 96

See application file for complete search history.

(56) References Cited

U.S. PATENT DOCUMENTS

| | | | | |
|---|---|---|---|---|
| 3,757,371 | A * | 9/1973 | Martin | 441/94 |
| 4,560,356 | A | 12/1985 | Burr | |
| 4,887,987 | A | 12/1989 | Kato | |
| 5,466,179 | A | 11/1995 | Jeffrey, Sr. | |
| 5,738,557 | A | 4/1998 | Biesecker | |
| 5,794,971 | A | 8/1998 | Boydston et al. | |
| 5,954,556 | A | 9/1999 | Powers | |
| 6,004,177 | A | 12/1999 | Biesecker et al. | |
| 6,231,411 | B1 | 5/2001 | Vinay | |
| 6,746,041 | B2 | 6/2004 | Chang et al. | |
| 6,899,583 | B2 | 5/2005 | Barden | |
| 7,305,715 | B2 | 12/2007 | Orsos | |

* cited by examiner

*Primary Examiner* — Edwin Swinehart

(74) *Attorney, Agent, or Firm* — JP Webb; Jason P. Webb; Danny Y. H. Cheng

(57) ABSTRACT

A personal floatation device includes an attachment device that selectably couples to a user's body. The personal floatation device includes a housing that couples to the attachment device. The housing includes a base and an outer wall extending outwardly from a perimeter of the base. The housing includes an inner wall enclosed by the outer wall and extending outwardly from an interior region of the base. The housing includes a compressed air container extending through the inner wall. The housing includes a compressed air activation device functionally coupled to the compressed air container such that, when triggered, releases air therefrom. The housing includes an air bladder in fluid communication with the compressed air container. The housing includes a breakaway cover coupled to the outer wall that detaches when exposed to pressure from the air bladder inflating. The housing include a trigger device functionally coupled to the compressed air activation device.

14 Claims, 7 Drawing Sheets

PERSONAL FLOATATION DEVICE

CROSS-REFERENCE TO RELATED APPLICATIONS

This invention claims priority, under 35 U.S.C. §120, to the U.S. Provisional Patent Application No. 61/691,095 by Daniel P. McCarthy filed on Aug. 20, 2013, which is incorporated by reference herein in its entirety.

FIELD OF THE INVENTION

The present invention relates to floatation devices, specifically to a personal floatation devices.

DESCRIPTION OF THE RELATED ART

A personal flotation device (abbreviated as PFD; also referred to as, lifejacket, life preserver, Mae West, life vest, life saver, cork jacket, buoyancy aid, flotation suit, etc.) is a device designed to assist a wearer, either conscious or unconscious, to keep afloat.

Devices designed and approved by authorities for use by civilians (recreational boaters, sailors, canoeists, kayakers, etc.) differ from those designed for use by passengers and crew of aircraft (helicopters, airplanes) and of commercial vessels (tugs, passenger ferries, cargo ships). Devices used by military (army, air force, special forces, marines, navy, coast guard) and police and enforcement agencies generally have features not found on civilian or commercial models, for example compatibility with other worn kit (e.g. survival vest, bulletproof vest/body armor, equipment harness, rappelling harness, parachute) and use of ballistic nylon cloth to protect pressurized carbon dioxide ($CO_2$) canisters used for inflating the vest from injuring the wearer if struck by a round from a firearm. The ballistic cloth keeps the fragments from the canister from becoming shrapnel injurious to the user.

PFDs are available in different sizes to accommodate variances in body weight. Designs will differ depending on convenience preferred for various levels of protection. Generally, the simplest and least buoyant type of PFD comes in the form of nylon-lined foam vests, used predominantly in watersports such as kayaking, canoeing and dinghy sailing.

Buoyancy aids are designed to allow freedom of movement while providing necessary buoyancy to a user. They are also designed for minimal maintenance and as they are generally constructed from foam, can be mass-produced inexpensively making them one of the most commonly seen form of PFDs. Buoyancy aids also come designed especially for children. These vests feature crotch straps designed to be worn between the legs of the wearer and also a headrest flap.

Some improvements have been made in the field. Examples of references related to the present invention are described below in their own words, and the supporting teachings of each reference are incorporated by reference herein:

U.S. Pat. No. 5,954,556, issued to Powers, discloses an inflatable life saving belt comprising a gas source linked to a reusable inflatable bag at multiple locations on the belt. The bags are attached to the gas source in a manner such that should one of the bags fail to deploy, the other bags can be activated.

U.S. Pat. No. 5,466,179, issued to Jeffrey, Sr., discloses a self inflating flotation device comprising a pouch adapted to be worn about the waist of a user until needed. The device includes an inflatable chamber therein. A compressed air cylinder is coupled to a one-way valve in fluid communication with the interior of the chamber for quickly and easily inflating the chamber.

U.S. Pat. No. 6,231,411, issued to Vinay, discloses a fashionable life saving device utilizes the look of casual clothing such as shorts, pants, bathing suits or skorts to disguise inflatable chambers, a gas canister and safety devices including a manual inflation tube, thereby providing a subtle way to ensure safety in and around the water. When inflated, the chambers rest under the users arms, but are safely attached to his waist or the lower part of his body for security and safety.

U.S. Pat. No. 5,738,557, issued to Biesecker, discloses a pocket-sized, portable, flotation device that folds into a carrying case, which is the size of a cellular phone or camera. It can be carried upon a person in a shirt pocket or clipped to a waistline belt. The flotation device inflates into a diamond-shaped collar. The diamond shape of the flotation collar is uniquely constructed, so as to provide sufficient buoyancy to keep the user's head afloat. The diamond shape is also useful in preventing deflation of the device; it uniquely separates the flotation balloon into four separate compartments or cells, each of which is substantially sealed from adjacent compartments to prevent or reduce deflation of the adjacent cells through puncture or other mishap to one of the cells. The unique sealing construction is operative by the simple means of an approximately sixty-degree construction angle at the apex seam between the lobes. The acute angle between the divided lobes of the balloon effectively seals from each other the individual compartments on each lobe of the collar. Thus, full deflation is prevented, should one of the compartments become punctured.

The inventions heretofore known suffer from a number of disadvantages which include but not limited to not being adapted to use by children, being difficult to use, being difficult to deploy, imputing a stigma to the wearer, requiring complicated actions, restricting motion of the user, being heavy, being cumbersome, failing to provide peace of mind, being subject to accidental deployment, being vulnerable to environmentally induced damage, being expensive to manufacture, being difficult to wear, substantially interfering with actions and/or motions required in water sports, and being bulky.

What is needed is a personal floatation device that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available floatation devices. Accordingly, the present invention has been developed to provide a deployable personal floatation device that solves one or more of the problems described herein and/or one or more problems that one of ordinary skill in the art would recognize having read this specification.

According to one embodiment of the invention, there is a personal floatation device that may include an attachment device that may selectably couple to a user's body. The attachment device may include an adjustment device that may selectively adjust an effective fitting of the attachment device to the user's body.

The personal floatation device may include a housing that may be coupled to the attachment device. The housing may be selectably coupled to the attachment device and may be selectably removable therefrom. The housing may include a base. The housing may include an outer wall that may be extending outwardly from a perimeter of the base. The housing may include an inner wall that may be enclosed by the outer wall and may be extending outwardly from an interior region of the base. The housing may include a compressed air container that may be extending through the inner wall. The housing may include a compressed air activation device that may be disposed in an interior of the inner wall and may be functionally coupled to the compressed air container such that, when triggered, may release air therefrom. The housing may include an air bladder that may be in fluid communication with the compressed air container. The housing may include a breakaway cover that may be coupled to the outer wall that may detach when exposed to pressure from the air bladder inflating. The breakaway cover may be coupled to the outer wall by a plurality of posts and barbs and wherein the breakaway cover may break completely away from the housing.

The housing may include a trigger device that may be functionally coupled to the compressed air activation device. The trigger device may include a slack cord that may be sized to be substantially longer than a distance from an exterior of the housing to the inner wall. The slack cord may couple to a trigger attachment of the compressed air activation device. The trigger device may include a breakaway grasping structure that may be coupled to the housing and the slack cord. The structure may break away from the housing when significant force is applied thereto. The breakaway grasping structure may include a pair of barbs that may be shaped of an elastic material, such that when sufficient force is applied there-against, the barbs may be pulled free from the outer wall and thereby release the grasping structure from the housing. The breakaway grasping structure may be rigidly coupled to the housing.

The personal floatation device may include a slot through an upper region of the outer wall through which the trigger device may be disposed such that when the trigger device is pulled the slack cord may be pulled free from the outer wall.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
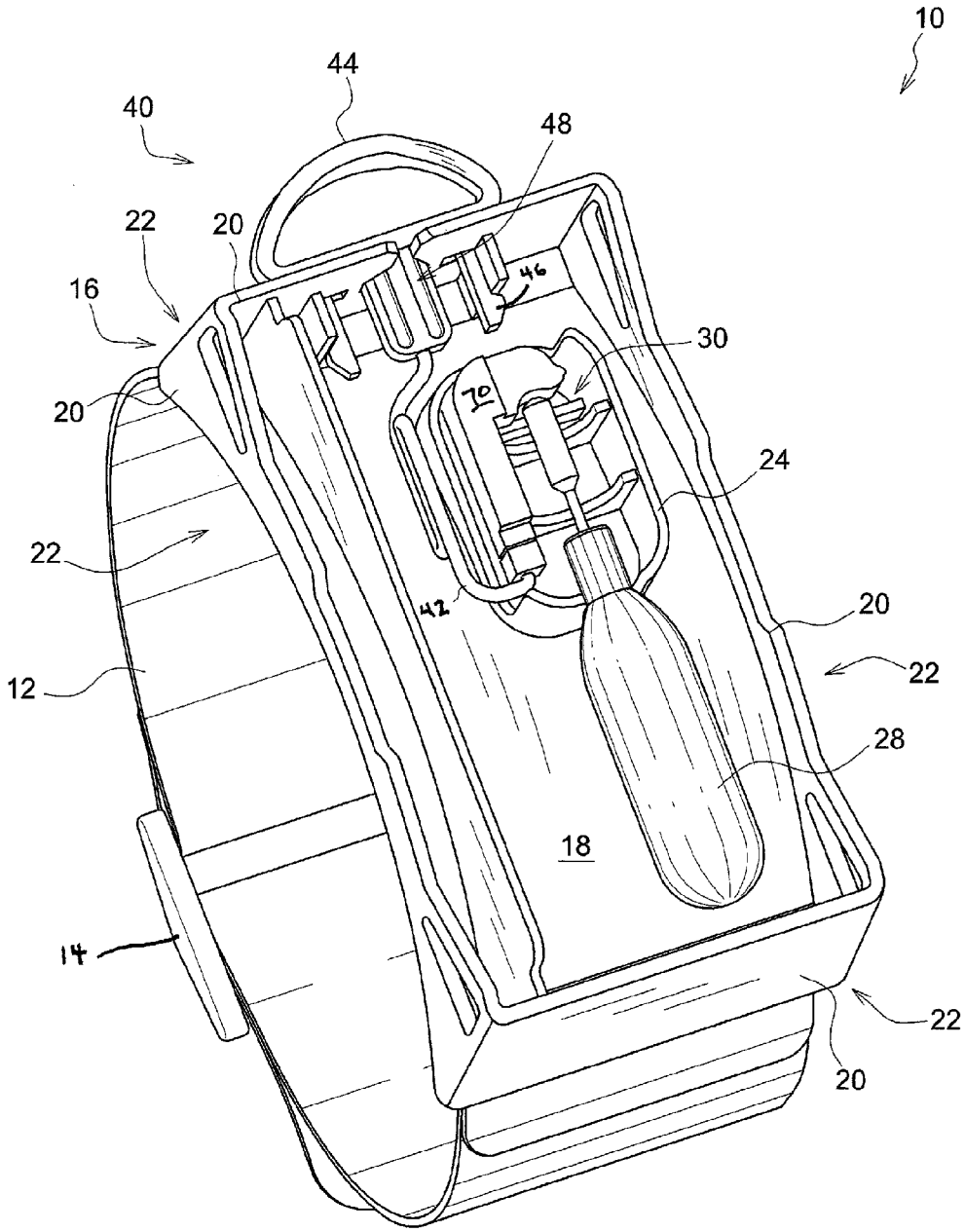
FIG. 1 is a top perspective view of a personal floatation device with cover and air bladder removed, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

FIG. 1 is a top perspective view of a personal floatation device with cover and air bladder removed to show the inner workings thereof, according to one embodiment of the invention. There is shown a personal floatation device 10 including an attachment device 12 coupled to a housing 16 having a base 18, an outer wall 20, an inner wall 24, a compressed air activation device 30, and a trigger device 40. The illustrated personal floatation device is compact and reduces the likelihood of accidental deployment while taking part in water sports/activities. At a distance, it is similar in exterior appearance to commonly worn accessories and therefore may be worn by and/or decorated in manners that are consistent with existing patterns. Further, the illustrated structure is tear resistant and protects the inner components from damage due to environmental factors and impacts without adding undue weight and/or bulk.

The illustrated personal floatation device 10 includes an attachment device 12 that selectably couples to a user's body. The illustrated attachment device 12 includes an adjustment device 14 that selectively adjust an effective fitting of the attachment device 12 to the user's body. The illustrated attachment device 12 is a band and buckle system. Various other/additional attachment devices and/or structures are contemplated herein, including but not limited to hook and loop straps, snaps, buttons, tongue and groove coupling structures, elastic materials, ties and the like and combinations thereof. The attachment device is configured to couple to a portion of the user's body, generally a wrist or ankle. It is advantageous if the attachment device is adjustable and/or capable of attaching to variously sized body parts so that a single device may be used for a variety of individuals, thereby not requiring different (or many different) sizes when the product is sold to the public.

The illustrated personal floatation device 10 includes a housing 16 coupled to the attachment device 12. The illustrated housing 16 may be selectably coupled to the attachment device 12 and may be selectably removable therefrom. Accordingly, the housing may be replaced as needed, such as but not limited to wherein the housing is treated as a disposable/replaceable cartridge once deployed. The illustrated housing 16 includes a base 18 having an outer wall 20 extending outwardly from a perimeter 22 of the base 18. There is also an inner wall 24 enclosed by the outer wall 20 and extending outwardly from an interior region of the base 18. The illustrated inner and outer walls are rigid and configured to protect and provide structure for the device. Further, the inner and outer walls of the housing are spaced apart from each other such that impacts and/or damage to the outer wall of the housing is not immediately transferred to the inner housing. Further, the outer wall protects the structure inside the housing from being accidentally manipulated by the user or by coming into contact with other structures (plants, rocks, strong water currents, etc.). The housing 16 is configured to secure/protect/house a compressed air container extending through the inner wall 24. The housing 16 includes a compressed air activation device 30 disposed in an interior of the inner wall 24 and is functionally coupled to the compressed air container such that, when triggered, may release air therefrom.

The illustrated housing 16 includes a trigger device 40 functionally coupled to the compressed air activation device 30. The illustrated trigger device 40 includes a slack cord 42 that is sized to be substantially longer than a distance from an exterior of the housing to the inner wall. Generally, a slack length (the amount of extra length available in the slack cord that is greater than the length needed to connect the handle to the compressed air activation device 30) of about equal to or greater than the length of a portion of the handle that protrudes into the housing will be appropriate so that the device does not accidentally deploy even if the handle is completely removed from the housing. Generally, a slack length of less than about the width or length of the housing will be appropriate because having a slack length that is too long will increase the likelihood of the slack cord being entangled on something. A slack cord that has slack lengths as described above is also substantially longer than a distance from an exterior of the housing to the inner wall. As a non-limiting example, if a slack cord must be at least 2 inches long in order to connect a handle to a compressed air activation device, and the handle protrudes into the housing ½ an inch, a distance from an exterior of the housing to the inner wall is 1¾ inches, and the width and length of the housing is 1.5 inches by 4 inches, then a slack cord having an effective maximum length of between about 2.5, 2.75, 3, 3.25, 3.5, 3.75, and 4 inches would be both substantially longer than a distance from an exterior of the housing to the inner wall and would be an appropriate length (not too long). Wherein the slack cord is substantially elastic, the slack cord may be sized to have a length that is substantially longer than a distance from an exterior of the housing to the inner wall by having a maximum length (length at which the elastic slack cord does not increase in length anymore at a force less than that sufficient to cause the air canister to be punctured) that is substantially longer than a distance from an exterior of the housing to the inner wall.

Accordingly, the slack cord 42 has slack when the device is not yet triggered/deployed but reaches a point when pulled wherein there is no longer slack and the air canister may be punctured by further pulling on the slack cord. This is advantageous, because the device will not immediately trigger if the breakaway grasping structure (handle) 44 is pulled free from the outer wall. Thus, if the handle 44 is accidentally broken free, the user may be able to reconnect the handle at a later time without the device immediately and automatically deploying. However, if the handle 44 is intentionally broken away, it is a simple thing for the user to continue the very same action that caused the breakaway to occur to use up the slack in the slack cord 42 and cause the slack cord to transmit force from the user to cause the device to deploy.

The illustrated slack cord 42 is coupled to a trigger attachment 70 of the compressed air activation device 30. The illustrated trigger device 40 includes a breakaway grasping structure 44 coupled to the housing 16 and the slack cord 42. The structure 44 may break away from the housing 16 when significant force is applied thereto. The illustrated breakaway grasping structure 44 includes a pair of barbs 46 that are shaped of an elastic material (generally plastic), and shaped and composed such that when sufficient force is applied there-against by pulling on the handle, the barbs 46 are pulled free from the outer wall 20 and thereby release the grasping structure 44 from the housing 16. The barbs are of the type wherein it is easy to insert the barbs into slots in the housing but harder to pull them free once the barbs are engaged with the outer wall of the housing. Other similar structures are contemplated wherein it is easier to attached the handle to the outer wall than it is to break it away. The breakaway structure may be of a type that is repeatably removable or it may be of a type such that breaking the structures apart damages structure such that it may not be reconnected without repair. The breakaway grasping structure 44 is rigidly coupled to the housing 16 but in a manner that with the appropriate force and action a user may break it free from the housing.

The personal floatation device 10 includes a slot 48 through an upper region of the outer wall 20 through which the trigger device 40 is disposed such that when the trigger device 40 is pulled the slack cord 42 is pulled free from the outer wall 20. The illustrated slot is shaped to include an enlarged region at a bottom of the slot that is sized to receive the unbarbed protrusion of the handle. The slot narrows above that region but is still sufficiently large to permit the slack cord to travel therethrough. Accordingly, when the handle is pulled free from the slot, since the illustrated slack cord is coupled to the unbarbed protrusion of the handle, the slack cord is not forced to stay within a limited region of the slot, but may travel higher than the enlarged slot region. Since the slot extends to the top edge of the outer wall, the slack cord may even be pulled completely free from the outer wall if the breakaway cover is also broken away. This advantageously prevents the slack cord from being caught/trapped/tangled inside the outer wall and reduces the likelihood that the slack cord be severed or otherwise prevented from performing its intended function.

The illustrated compressed air activation device 30 includes an L-shaped pivoting structure coupled to the slack cord and disposed inside the inner wall of the housing. The L-shaped pivoting structure leverages the force applied through the slack cord to a puncture pin disposed against/adjacent to a compressed air canister than is disposed within the housing. The puncture pin, when force is applied thereto presses against the compressed air canister at a point intended to be punctured to release compressed air therefrom. The L-shaped pivoting structure is generally coupled to the housing at a region at or near the elbow of the L-shaped structure. In the illustrated example, the longer portion of the L-shaped structure is coupled to the slack cord. This allows that longer portion to operate as a lever arm and multiply the force from the slack cord.

The personal floatation device may include a housing that may be coupled to the attachment device. The housing may be selectably coupled to the attachment device and may be selectably removable therefrom. The housing may include a base. The housing may include an outer wall that may be extending outwardly from a perimeter of the base. The housing may include an inner wall that may be enclosed by the outer wall and may be extending outwardly from an interior region of the base. The housing may include a compressed air container that may be extending through the inner wall. The housing may include a compressed air activation device that may be disposed in an interior of the inner wall and may be functionally coupled to the compressed air container such that, when triggered, may release air therefrom. The housing may include an air bladder that may be in fluid communication with the compressed air container. The housing may include a breakaway cover that may be coupled to the outer wall that may detach when exposed to pressure from the air bladder inflating. The breakaway cover may be coupled to the outer wall by a plurality of posts and barbs and wherein the breakaway cover may break completely away from the housing.

The housing may include a trigger device that may be functionally coupled to the compressed air activation device. The trigger device may include a slack cord that may be sized to be substantially longer than a distance from an exterior of the housing to the inner wall. The slack cord may couple to a trigger attachment of the compressed air activation device. The trigger device may include a breakaway grasping structure that may be coupled to the housing and the slack cord. The structure may break away from the housing when significant force is applied thereto. The breakaway grasping structure may include a pair of barbs that may be shaped of an elastic material, such that when sufficient force is applied there-against, the barbs may be pulled free from the outer wall and thereby release the grasping structure from the housing. The breakaway grasping structure may be rigidly coupled to the housing.

The personal floatation device may include a slot through an upper region of the outer wall through which the trigger device may be disposed such that when the trigger device is pulled the slack cord may be pulled free from the outer wall.

Advantageously, the illustrated personal floatation device provides a compact, reliable, error resistant system for increasing the personal safety of participants in water activities, including but not limited to swimming, surfing, sailing, boating, water skiing and the like without being bulky, heavy or difficult to use. Further, the illustrated personal floatation device may be attached to various regions of the user's body, thereby permitting multiple modes of use that can be compatible with sports wear and/or equipment used during various activities. Further, the device is resistant to damage, impact, and entangling structures. Thereby providing a less troublesome experience than that suffered by users of existing devices.

Figure 2:
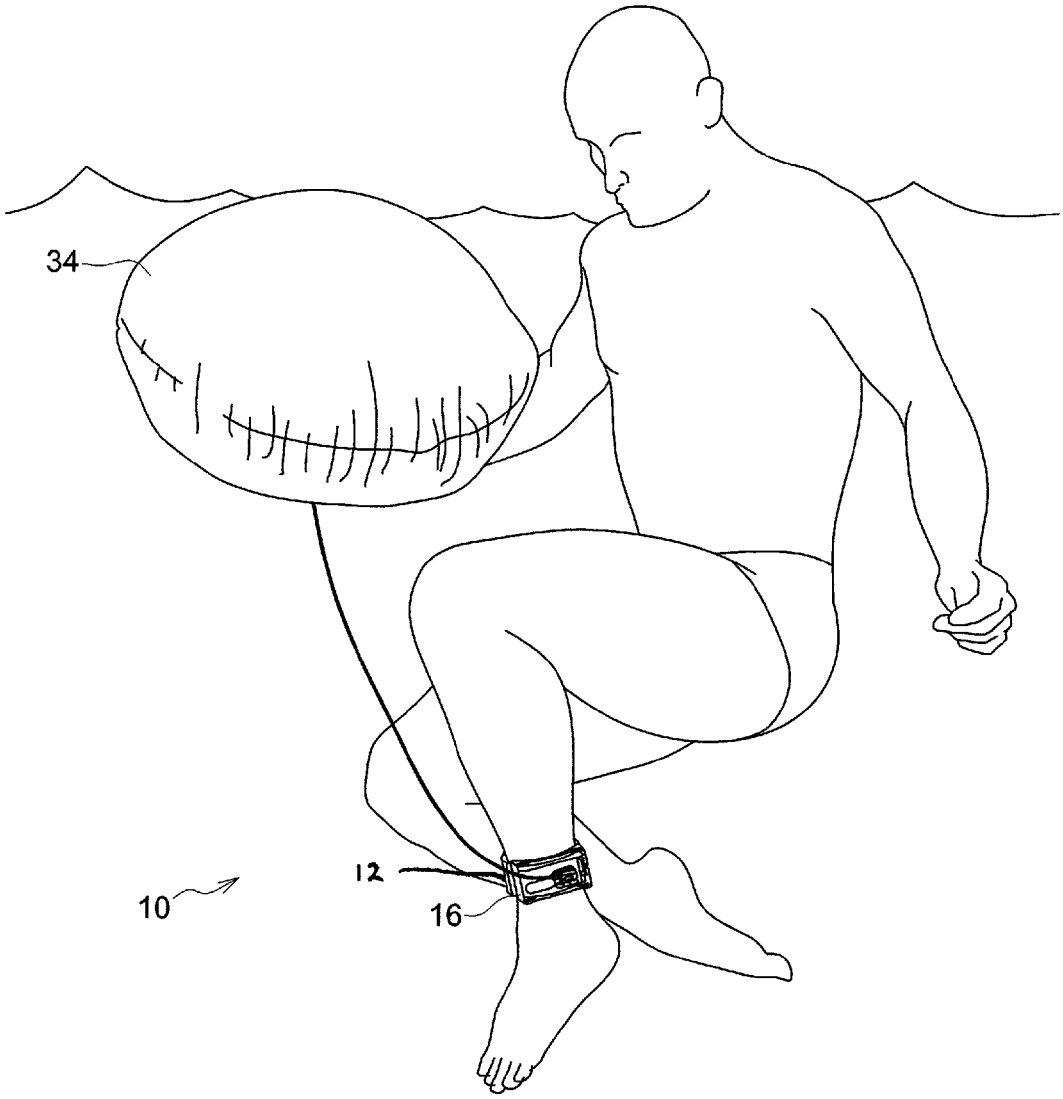
FIG. 2 is a perspective view of a personal floatation device coupled to a leg of a user and deployed in a body of water, according to one embodiment of the invention.

FIG. 2 is a perspective view of a personal floatation device coupled to a leg of a user and deployed in a body of water, according to one embodiment of the invention. There is shown a personal floatation device 10 including an attachment device 12 coupling a user's body and an inflated air bladder 34 for the user to support their-self thereon.

The illustrated personal floatation device 10 includes an attachment device 12 that selectably couples to a user's body. The illustrated attachment device 12 is coupled to an ankle region of a user. The illustrated personal floatation device 10 includes a housing 16 coupled to the attachment device 12, wherein the housing 16 is selectably coupled to the attachment device 12. The personal floatation device 10 includes an air bladder 34, inflated, wherein the user may support their-self thereon to stay afloat in water. The air bladder 34 is coupled to the housing of the personal floatation device 10 by a tether or cord.

The illustrated personal floatation device 10 is configured to assist swimmers in staying afloat. The personal floatation device 10 includes an attachment device 12 configured to selectably couple about a swimmer. The illustrated attachment device 12 is selectably coupled to an ankle of the swimmer. The attachment device 12 is coupled to a cord, such as a tether or leash. The cord or leash is configured to couple to an inflatable air bladder 34.

Figure 3:
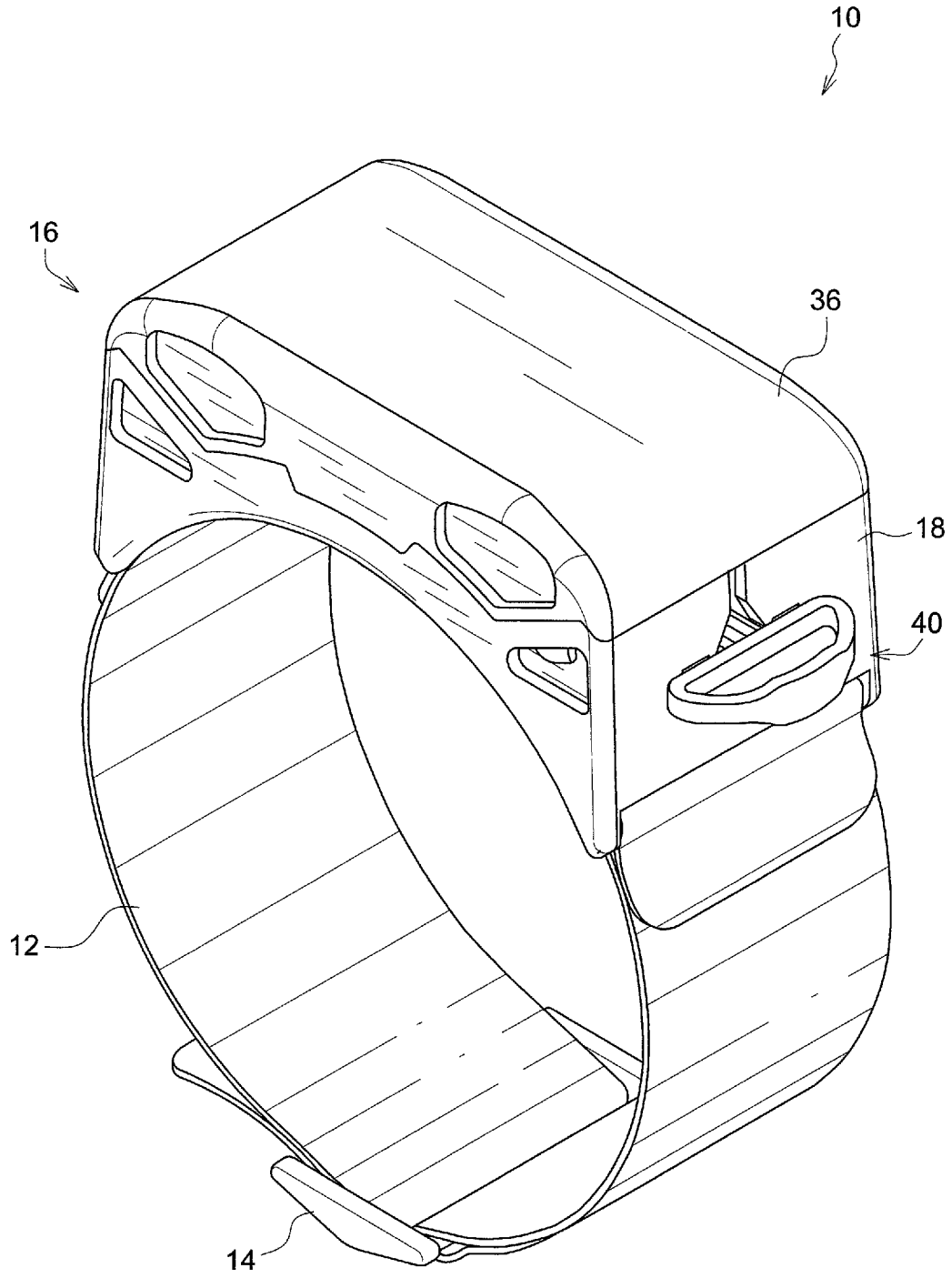
FIG. 3 is a perspective view of a personal floatation device, according to one embodiment of the invention.

FIG. 3 is a perspective view of a personal floatation device, according to one embodiment of the invention. There is shown a personal floatation device 10 including an attachment device 12 and a housing 16 having a base 18, a breakaway cover 36, and a trigger device 40.

The illustrated personal floatation device 10 includes an attachment device 12 selectably coupled to a user's body. The attachment device 12 includes an adjustment device 14 that selectively adjusts an effective fitting of the attachment device 12 to the user's body.

The personal floatation device 10 includes a housing 16 coupled to the attachment device 12. The housing 16 is selectably coupled to the attachment device 12 and is selectably removable therefrom. The housing 16 includes a base 18 configured to secure the components and modules of the personal floatation device 10. The housing 16 includes a breakaway cover 36 coupled to the housing 16 that detaches when exposed to pressure from an air bladder inflating. The housing 16 includes a trigger device 40 functionally coupled to the housing 16. The trigger device 40 activates the inflation of an air bladder of the personal floatation device 10

The illustrated personal floatation device 10 is configured to assist swimmers in staying afloat. The personal floatation device 10 includes an attachment device 12 configured to selectably couple about a limb, such as a leg or arm, of a swimmer. The personal floatation device 10 includes a trigger device 40 configured to deploy a gas, from a gas cartridge, into an inflatable balloon or bladder. The trigger device 40 is activated by an actuator. The illustrated actuator is a handle configured to be pulled and thereby activating the trigger device 40. The trigger device 40 is configured to puncture a gas cartridge, thereby releasing the gas into the bladder or balloon. The inflated air bladder floats to a top surface of the water, thereby assisting the swimming in staying afloat.

Figure 4:
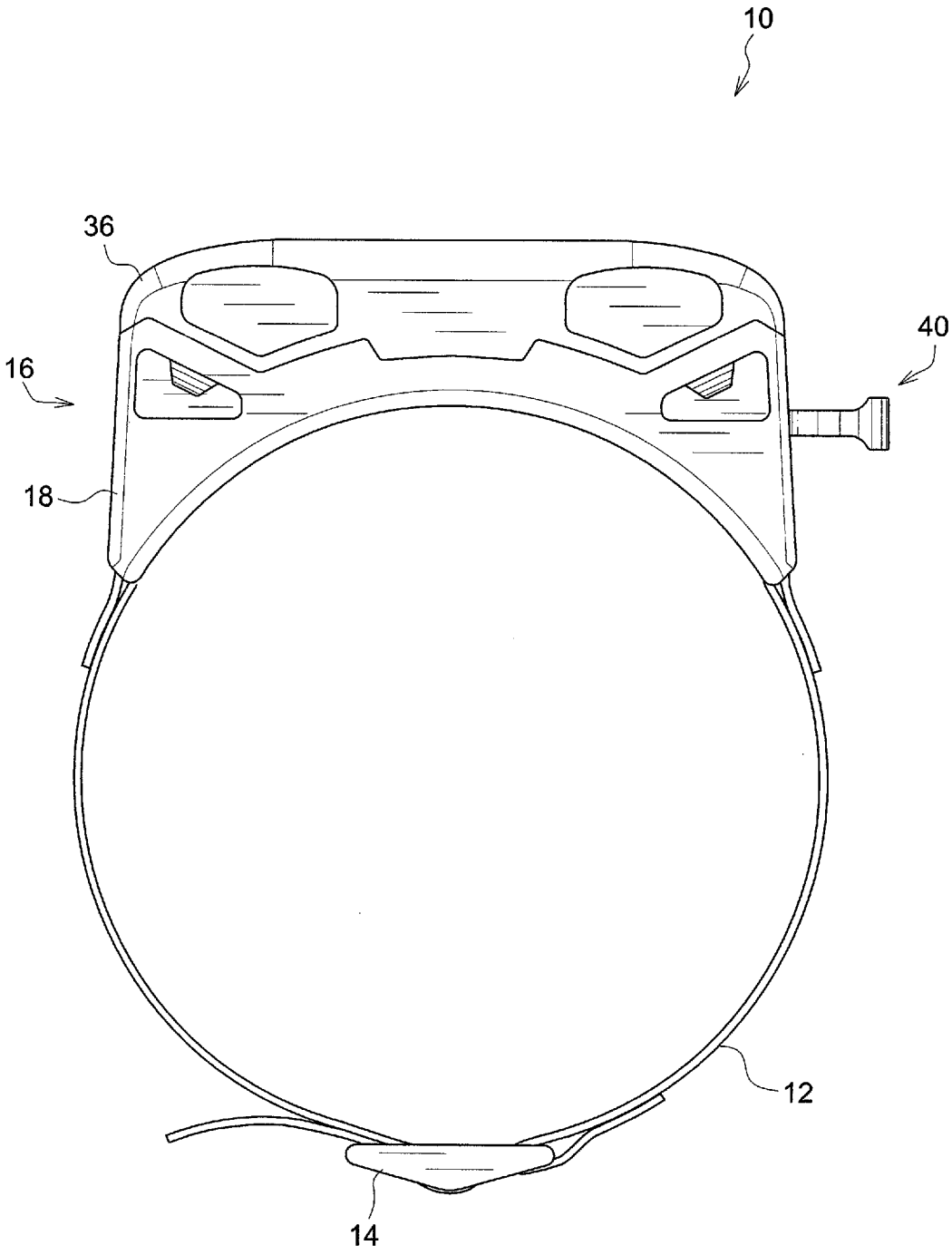
FIG. 4 is a side elevational view of a personal floatation device, according to one embodiment of the invention.

FIG. 4 is a side elevational view of a personal floatation device, according to one embodiment of the invention. There is shown a personal floatation device 10 including an attachment device 12 and a housing 16 having a base 18, a breakaway cover 36, and a trigger device 40.

The personal floatation device 10 includes a housing 16 coupled to the attachment device 12. The housing 16 is selectably coupled to the attachment device 12 and is selectably removable therefrom. The illustrated attachment device 12 includes an adjustment device 14 to selectively adjust an effective fitting of the attachment device 12 to the a user's body. The housing 16 includes a base 18 configured to secure the components and modules of the personal floatation device 10. The housing 16 includes a breakaway cover 36 coupled to the housing 16 that detaches when exposed to pressure from an air bladder inflating. The housing 16 includes a trigger device 40 functionally coupled to the housing 16. The trigger device 40 activates the inflation of an air bladder of the personal floatation device 10

Of particular note, there is shown a trigger device 40 that secures to the base 18 of the housing 16. The trigger device 40 is attached to a cord or tether that couples to the air bladder disposed within the housing 16. The trigger device 40 effectuates deployment of the air bladder while keeping the trigger device 40 coupled to the base and through the tether, the air bladder to the base 18 of the housing 16. The trigger device 40 is configured to permit one-way selective coupling of the trigger device 40 to the base 18 of the housing 16 and to not permit its removal therefrom afterwards without special tools, application of force, and/or destruction of the personal floatation device 10. Accordingly, users may be secure in the use thereof, but the trigger device 40 structure need not be manufactured together with, nor sold together with the housing 16 or the attachment device 12. This advantageously may reduce costs and increase options for purchasers of the personal floatation device 10.

The illustrated personal floatation device 10 is configured to assist swimmers in staying afloat. The personal floatation device 10 includes an attachment device 12 configured to selectably couple about a swimmer, such as about an ankle or wrist region. The attachment device 12 is coupled to a base 18 of a housing 16 of the personal floatation device 12, wherein the housing 16 is coupled to an exterior surface of the attachment device 12 and configured to extend out therefrom. The base 18 is configured to support a trigger device 40. The trigger device 40 may be configured to be used once and removed from the base 18. The trigger device 40 may be configured to be a cartridge configured to attach to the base 18 of the housing 16.

Figure 5:
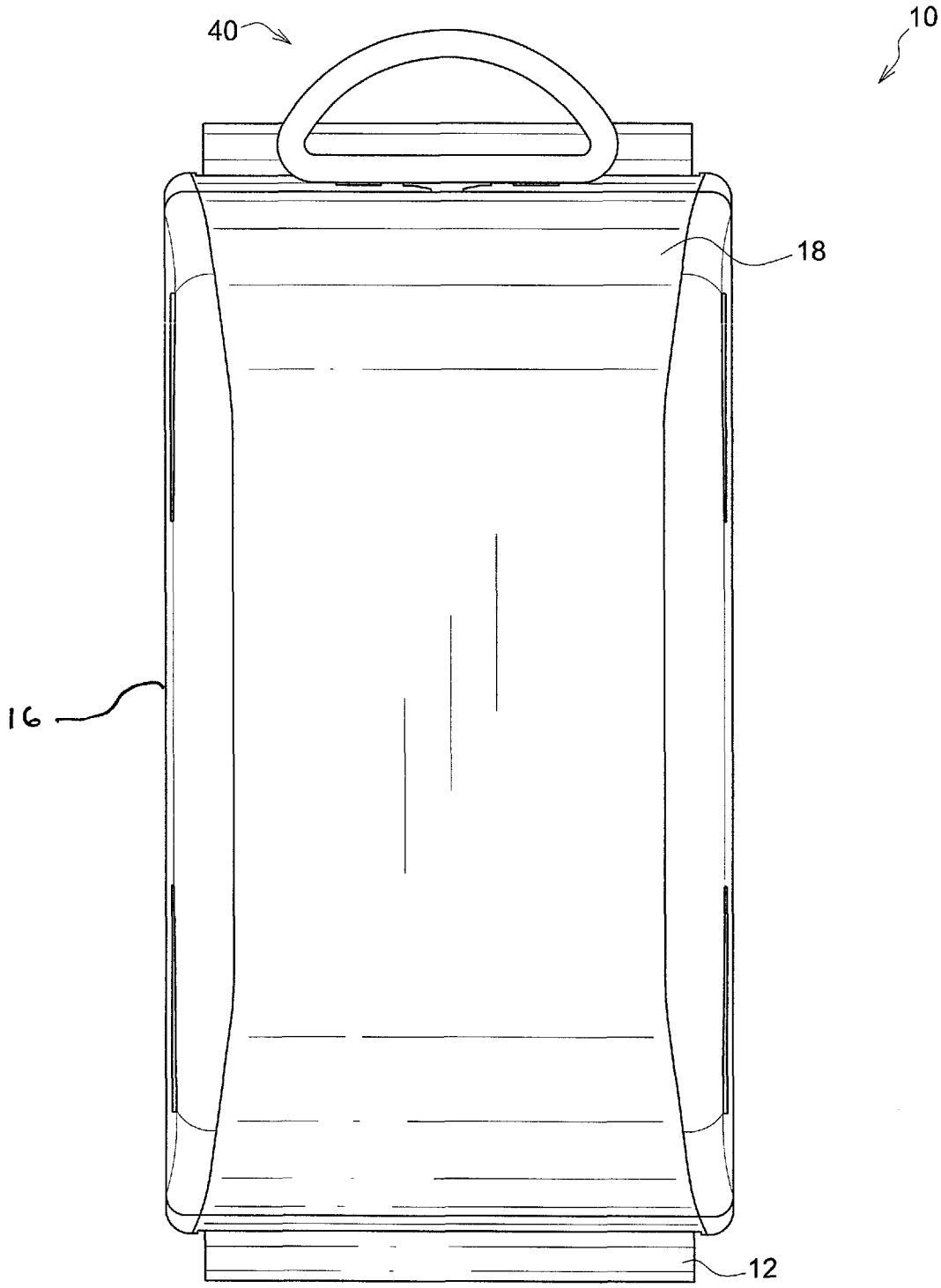
FIG. 5 is a top plan view of a personal floatation device, according to one embodiment of the invention.

FIG. 5 is a top plan view of a personal floatation device, according to one embodiment of the invention. There is shown a personal floatation device 10 including an attachment device 12 and a housing 16 having a base 18 and a trigger deice 40.

The illustrated personal floatation device 10 is configured to support a user in distress while swimming in water. The personal floatation device 10 includes an attachment device 12 that selectably couples to a user's body. The personal floatation device 10 includes a housing 16 that couples to the attachment device 12. The housing 16 is selectably coupled to the attachment device 12 and may be selectably removable therefrom. The housing 16 includes a base 18 that is selectably coupleable to the attachment device 12. The housing 16 includes a trigger device 40 functionally coupled to a compressed air activation device disposed within the housing 16. The trigger device 40 is configured to actuate the compressed air activation device, thereby inflating an air bladder of the personal floatation device 10.

The illustrated personal floatation device 10 is configured to assist swimmers to stay afloat while in a body of water. The personal floatation device 10 includes a trigger device 40 configured to deploy an inflated air bladder configured to assist a swimmer in staying afloat. The trigger device 40 is coupled to an attachment device 12 configured to couple to a limb, such as a leg or arm, of a swimmer. The attachment device 12 includes an adjustment device configured to adjust the length of the attachment device 12, thereby providing a secure fit about the limb of the swimmer. The attachment device 12 may include a hook and loop attachment device, such as a Velcro strap.

Figure 6:
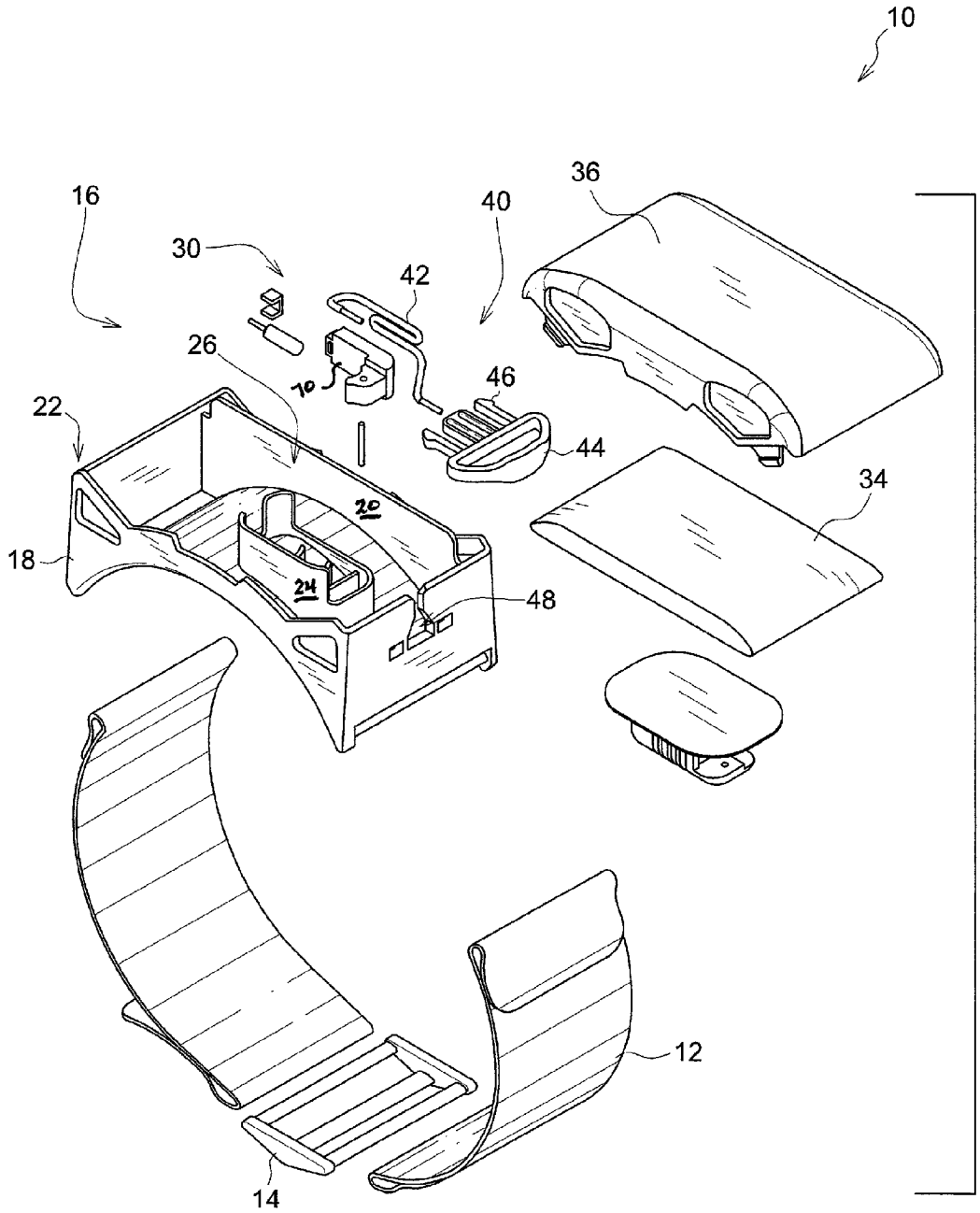
FIG. 6 is an exploded perspective view of a personal floatation device, according to one embodiment of the invention.

FIG. 6 is an exploded perspective view of a personal floatation device, according to one embodiment of the invention. There is shown a personal floatation device 10 including an attachment device 12, a housing 16 having a base 18, an outer wall 20, an inner wall 24, a compressed air activation device 30, an air bladder 34, a breakaway cover 36, and a trigger device 40.

The illustrated personal floatation device 10 includes an attachment device 12 that selectably couples to a user's body. The attachment device 12 includes an adjustment device 14 that selectively adjust an effective fitting of the attachment device 12 to the user's body.

The personal floatation device 10 includes a housing 16 coupled to the attachment device 12. The housing 16 may be selectably coupled to the attachment device 12 and may be selectably removable therefrom. The housing 16 includes a base 18 having an outer wall 20 extending outwardly from a perimeter 22 of the base 18. The housing 16 includes an inner wall 24 enclosed by the outer wall 20 and extending outwardly from an interior region 26 of the base 18. The housing 16 is configured to secure a compressed air container extending through the inner wall 24. The housing 16 includes a compressed air activation device 30 disposed in an interior of the inner wall 24 and is functionally coupled to the compressed air container such that, when triggered, may release air therefrom. The housing 16 includes an air bladder 34 in fluid communication with the compressed air container, such as but not limited to having an aperture disposed over and about the inner wall and configured to self-seal once separated therefrom. The housing 16 includes a breakaway cover 36 coupled to the outer wall 20 and detaches when exposed to pressure from the air bladder inflating. The breakaway cover 36 is coupled to the outer wall 20 by a plurality of posts and barbs 38 and wherein the breakaway cover 36 may break completely away from the housing 16.

The housing 16 includes a trigger device 40 functionally coupled to the compressed air activation device 30. The trigger device 40 includes a slack cord 42 that is sized to be substantially longer than a distance from an exterior of the housing to the inner wall. The slack cord 42 is coupled to a trigger attachment 70 of the compressed air activation device 30. The trigger device 40 includes a breakaway grasping structure 44 coupled to the housing 16 and the slack cord 42. The structure 44 may break away from the housing 16 when significant force is applied thereto. The breakaway grasping structure 44 includes a pair of barbs 46 that are shaped of an elastic material, such that when sufficient force is applied there-against, the barbs 46 are pulled free from the outer wall 20 and thereby release the grasping structure 44 from the housing 16. The breakaway grasping structure 44 is rigidly coupled to the housing 16.

The personal floatation device 10 includes a slot 48 through an upper region of the outer wall 20 through which the trigger device 40 is disposed such that when the trigger device 40 is pulled the slack cord 42 is pulled free from the outer wall 20.

Figure 7:
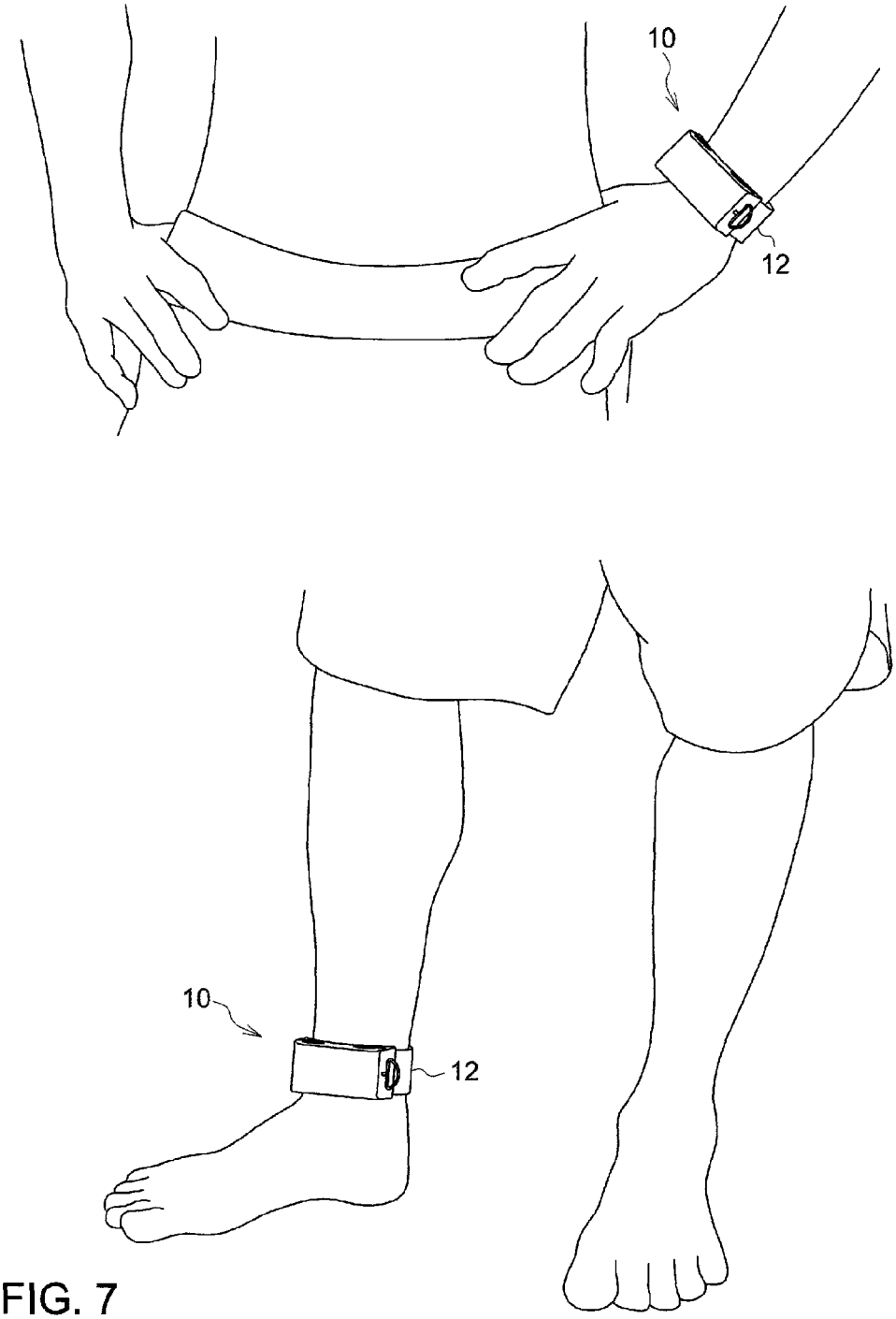
FIG. 7 illustrates a pair of perspective views of a personal floatation device coupled to a user in diverse manners, according to one embodiment of the invention.

FIG. 7 illustrates a pair of perspective views of a personal floatation device coupled to a user in diverse manners, according to one embodiment of the invention. There is shown a personal floatation device 10 including an attachment device 12 coupling to a user's body.

The illustrated personal floatation device 10 is coupled to a user's body by an attachment device that may selectably couple to a user's body. The attachment device may include an adjustment device that may selectively adjust an effective fitting of the attachment device to the user's body.

The personal floatation device may include a housing that may be coupled to the attachment device 12. The attachment device 12 attaches to a user about a wrist region or an ankle region. The attachment device 12 is selectably adjustable to adjust the length of the attachment device 12 to securely couple to the user's body.

There is shown a personal floatation device 10 configured to provide a self-inflating safety device for swimmers. The personal floatation device 10 may be used in the ocean, where there are strong currents, in open water such as lakes and rivers, or in a recreational setting such as an outdoor pool. The personal floatation device 10 is configured to deploy an inflatable balloon designed to assist the swimmer in staying afloat. The inflatable balloon is generally inflated by a carbon dioxide cartridge when activated, though other inflation systems may be utilized. The carbon dioxide cartridge is activated by pulling a handle configured to puncture the carbon dioxide cartridge, thereby releasing the carbon dioxide and inflating the balloon.

The illustrated personal floatation device is coupled about a wrist or an ankle of a swimmer by an attachment device 12. The attachment device 12 is configured to be selectably coupleable to the ankle or wrist. The attachment device 12 may be a band member configured to be coupled to other regions or areas of the body without impeding the swimmer from swimming. The attachment device 12 may be coupled about a waist area of a swimmer, such as a belt. The attachment device 12 may be coupled about the wrist of a swimmer, like a watch band. The attachment device 12 may be coupled about various body parts and still perform its intended function.

In one non-limiting embodiment of the invention there is a whistle or signaling device coupled to one or more portions of the device.

Advantageously, in the event of a rip current or any other compromising water event a child has safety at his/her fingertips. By simply reaching down and pulling the trigger device of the personal floatation device 10 around his/her ankle or wrist, a motion most young children can be taught in seconds, the balloon will automatically inflate and rise to the surface of the water. The child can then hold onto the personal floatation device 10 until help arrives. The inflated balloon stays tethered to the housing of the personal floatation deice 10 via a leash so there is no fear of the balloon floating or blowing away from the child. During work or play the wearer has full range of motion because the device is small, lightweight and non-cumbersome. The device 10 appears as a fashionable ankle band or wrist band and is not large or awkward looking like many other devices. Children will be happy to wear the device and parents will have peace of mind.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the figures illustrate particular sizing and spacing of the described portions of the device, it is understood that the various similar configurations are plethoric.

Additionally, although the figures illustrate a cylindric compressed air canister, it is understood that the air canister may be shaped/sized differently and that the housing would be shaped to function with the canister as shaped.

It is also envisioned that the breakaway cover may include various decorations, decorative layers, and the like.

It is expected that there could be numerous variations of the design of this invention.

Finally, it is envisioned that the components of the device may be constructed of a variety of materials, including but not limited to metals, ceramics, rubbers, plastics, fibers, composites, and the like and combinations thereof.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A personal floatation device, comprising:

an attachment device that selectably couples to a user's body;

a housing coupled to the attachment device and including:

a) a base;

b) an outer wall extending outwardly from a perimeter of the base;

c) an inner wall enclosed by the outer wall and extending outwardly from an interior region of the base;

d) a compressed air container extending through the inner wall;

e) a compressed air activation device disposed in an interior of the inner wall and functionally coupled to the compressed air container such that, when triggered, releases air therefrom;

f) an air bladder in fluid communication with the compressed air container;

g) a breakaway cover coupled to the outer wall that detaches when exposed to pressure from the air bladder inflating; and h) a trigger device functionally couples to the compressed air activation device; and including:

a slack cord sized to be substantially longer than a distance from an exterior of the housing to the inner wall, the slack cord coupled to a trigger attachment of the compressed air activation device; and a breakaway grasping structure coupled to the housing and the slack cord and structure breaks away from the housing when significant force is applied thereto.

2. The device of claim 1, further comprising a slot through an upper region of the outer wall through which the trigger device is disposed such that when the trigger device is pulled the slack cord may be pulled free from the outer wall.

3. The device of claim 1, wherein the breakaway grasping structure includes a pair of barbs shaped and of an elastic material such that when sufficient force is applied there-against, the barbs are pulled free from the outer wall and thereby release the grasping structure from the housing.

4. The device of claim 1, wherein the attachment device includes an adjustment device to selectively adjust an effective fitting of the attachment device to the user's body.

5. The device of claim 1, wherein the housing is selectably coupled to the attachment device and selectably removable therefrom.

6. The device of claim 1, wherein the breakaway cover is coupled to the outer wall by a plurality of posts and barbs and wherein the breakaway cover breaks completely away from the housing.

7. The device of claim 1, wherein the breakaway grasping structure is rigidly coupled to the housing.

8. A personal floatation device, comprising:

an attachment device that selectably couples to a user's body;

a housing coupled to the attachment device and including:

a) a base;

b) an outer wall extending outwardly from a perimeter of the base;

c) an inner wall enclosed by the outer wall and extending outwardly from an interior region of the base;

d) a compressed air container extending through the inner wall;

e) a compressed air activation device disposed in an interior of the inner wall and functionally coupled to the compressed air container such that, when triggered, releases air therefrom;

f) an air bladder in fluid communication with the compressed air container;

g) a breakaway cover coupled to the outer wall that detaches when exposed to pressure from the air bladder inflating; and h) a trigger device functionally couples to the compressed air activation device; and including:

a slack cord sized to be substantially longer than a distance from an exterior of the housing to the inner wall, the slack cord coupled to a trigger attachment of the compressed air activation device; and a breakaway grasping structure coupled to the housing and the slack cord and structure breaks away from the housing when significant force is applied thereto; wherein the breakaway grasping structure includes a pair of barbs shaped and of an elastic material such that when sufficient force is applied there-against, the barbs are pulled free from the outer wall and thereby release the grasping structure from the housing.

9. The device of claim 8, further comprising a slot through an upper region of the outer wall through which the trigger device is disposed such that when the trigger device is pulled the slack cord may be pulled free from the outer wall.

10. The device of claim 9, wherein the attachment device includes an adjustment device to selectively adjust an effective fitting of the attachment device to the user's body.

11. The device of claim 10, wherein the housing is selectably coupled to the attachment device and selectably removable therefrom.

12. The device of claim 11, wherein the breakaway cover is coupled to the outer wall by a plurality of posts and barbs and wherein the breakaway cover breaks completely away from the housing.

13. The device of claim 12, wherein the breakaway grasping structure is rigidly coupled to the housing.

14. A personal floatation device, comprising:

an attachment device that selectably couples to a user's body; wherein the attachment device includes an adjustment device to selectively adjust an effective fitting of the attachment device to the user's body;

a housing coupled to the attachment device, wherein the housing is selectably coupled to the attachment device and selectably removable therefrom and including:

a) a base;

b) an outer wall extending outwardly from a perimeter of the base;

c) an inner wall enclosed by the outer wall and extending outwardly from an interior region of the base;

d) a compressed air container extending through the inner wall;

e) a compressed air activation device disposed in an interior of the inner wall and functionally coupled to the compressed air container such that, when triggered, releases air therefrom;

f) an air bladder in fluid communication with the compressed air container;

g) a breakaway cover coupled to the outer wall that detaches when exposed to pressure from the air bladder inflating; wherein the breakaway cover is coupled to the outer wall by a plurality of posts and barbs and wherein the breakaway cover breaks completely away from the housing; and h) a trigger device functionally couples to the compressed air activation device; and including:

a slack cord sized to be substantially longer than a distance from an exterior of the housing to the inner wall, the slack cord coupled to a trigger attachment of the compressed air activation device;

a breakaway grasping structure coupled to the housing and the slack cord and structure breaks away from the housing when significant force is applied thereto; wherein the breakaway grasping structure includes a pair of barbs shaped and of an elastic material such that when sufficient force is applied there-against, the barbs are pulled free from the outer wall and thereby release the grasping structure from the housing; wherein the breakaway grasping structure is rigidly coupled to the housing; and a slot through an upper region of the outer wall through which the trigger device is disposed such that when the trigger device is pulled the slack cord may be pulled free from the outer wall.

* * * * *